US011029105B2

(12) United States Patent
Tai et al.

(10) Patent No.: US 11,029,105 B2
(45) Date of Patent: Jun. 8, 2021

(54) FRAME OF PISTOL

(71) Applicants: Chen-Hung Tai, New Taipei (TW); Hwa-Nung Lee, New Taipei (TW); Yo-Lun Chang, New Taipei (TW)

(72) Inventors: Chen-Hung Tai, New Taipei (TW); Hwa-Nung Lee, New Taipei (TW); Yo-Lun Chang, New Taipei (TW)

( * ) Notice: Subject to any disclaimer, the term of this patent is extended or adjusted under 35 U.S.C. 154(b) by 0 days.

(21) Appl. No.: 17/026,944

(22) Filed: Sep. 21, 2020

(65) Prior Publication Data

US 2021/0116193 A1 Apr. 22, 2021

(30) Foreign Application Priority Data

Oct. 17, 2019 (TW) ..... 108137481.0

(51) Int. Cl.
*F41A 3/66* (2006.01)
*F41A 3/72* (2006.01)

(52) U.S. Cl.
CPC ..... *F41A 3/72* (2013.01); *F41A 3/66* (2013.01)

(58) Field of Classification Search
CPC ..... F41A 21/488; F41C 33/00
USPC ..... 42/71.02; 89/163, 196
See application file for complete search history.

(56) References Cited

U.S. PATENT DOCUMENTS 5,649,383 A * 7/1997 Wesp ..... F41A 21/484 42/44
5,655,326 A * 8/1997 Levavi ..... F41A 17/00 42/70.01
7,347,022 B2 * 3/2008 Gussalli Beretta ..... F41A 19/15 42/69.01
2010/0263254 A1 * 10/2010 Glock ..... F41A 11/02 42/71.02

* cited by examiner

*Primary Examiner* — Reginald S Tillman, Jr.
(74) *Attorney, Agent, or Firm* — Birch, Stewart, Kolasch & Birch, LLP

(57) ABSTRACT

A frame of a pistol includes a handgrip portion, an upper frame portion, and a trigger guard. The handgrip portion defines a magazine well for accommodating a magazine. The upper frame portion is connected to the handgrip portion, and includes a barrel-receiving section having a bottom wall, two sidewalls extending upwardly and respectively from two opposite ends of the bottom wall, two through slots respectively formed in the sidewalls, a compression spring retaining groove formed in the bottom wall, and a spring plate retaining groove extending forwardly from the compression spring retaining groove. The trigger guard is connected to and is disposed between the handgrip portion and the upper frame portion.

2 Claims, 7 Drawing Sheets

FRAME OF PISTOL

CROSS-REFERENCE TO RELATED APPLICATION

This application claims priority of Taiwanese Patent Application No. 108137481, filed on Oct. 17, 2019.

FIELD

The present disclosure relates to a frame of a pistol.

BACKGROUND

The Glock pistol is a semi-automatic pistol widely used in many countries. Five generations of Glock pistol had been developed since its introduction in 1980, with slight adjustment in the structure thereof for each generation.

A user of the Glock pistol may disassemble and replace components thereof, particularly a frame of the Glock pistol made from high-molecular weight polymer, which is relatively easy to be worn out and needs to be replaced. However, the components of the different generations of the Glock pistol may differ, for example, a slide lock spring may be in the form of a spring plate or a compression spring, and the commercially available pistol cannot simultaneously accommodate these two types of the slide lock spring. That is, when the user wants to purchase anew frame of the Glock pistol, he/she needs to pay special attention whether the specification of the frame matches the original components thereof. In addition, manufacturers of the frame of the Glock pistol need to design different molds for making different specifications of the frame, which not only increases manufacturing cost, but also increases inventory cost after completion of the manufacturing process thereof.

SUMMARY

Therefore, an object of the present disclosure is to provide a frame of a pistol that can alleviate at least one of the drawbacks of the prior art.

According to the present disclosure, a frame of a pistol includes a handgrip portion, an upper frame portion, and a trigger guard. The handgrip portion defines a magazine well which is configured for accommodating a magazine. The upper frame portion extends along a front-rear direction and is connected to a top end of the handgrip portion. The upper frame portion includes a barrel-receiving section distal from the handgrip portion. The barrel-receiving section includes a bottom wall, two sidewalls extending upwardly and respectively from two opposite ends of the bottom wall, two through slots respectively formed in the sidewalls for receiving two opposite ends of a slide lock of a slide mechanism of the pistol, a compression spring retaining groove formed in the bottom wall between the through slots, and a spring plate retaining groove extending forwardly from a top end of the compression spring retaining groove. The through slots extend in a top-bottom direction transverse to the front-rear direction for permitting upward and downward movement of the two ends of the slide lock therein. The trigger guard is connected to and is disposed between the handgrip portion and the upper frame portion. The trigger guard is located below the through slots.

BRIEF DESCRIPTION OF THE DRAWINGS

Other features and advantages of the present disclosure will become apparent in the following detailed description of the embodiment with reference to the accompanying drawings, of which.

DETAILED DESCRIPTION

Figure 1:
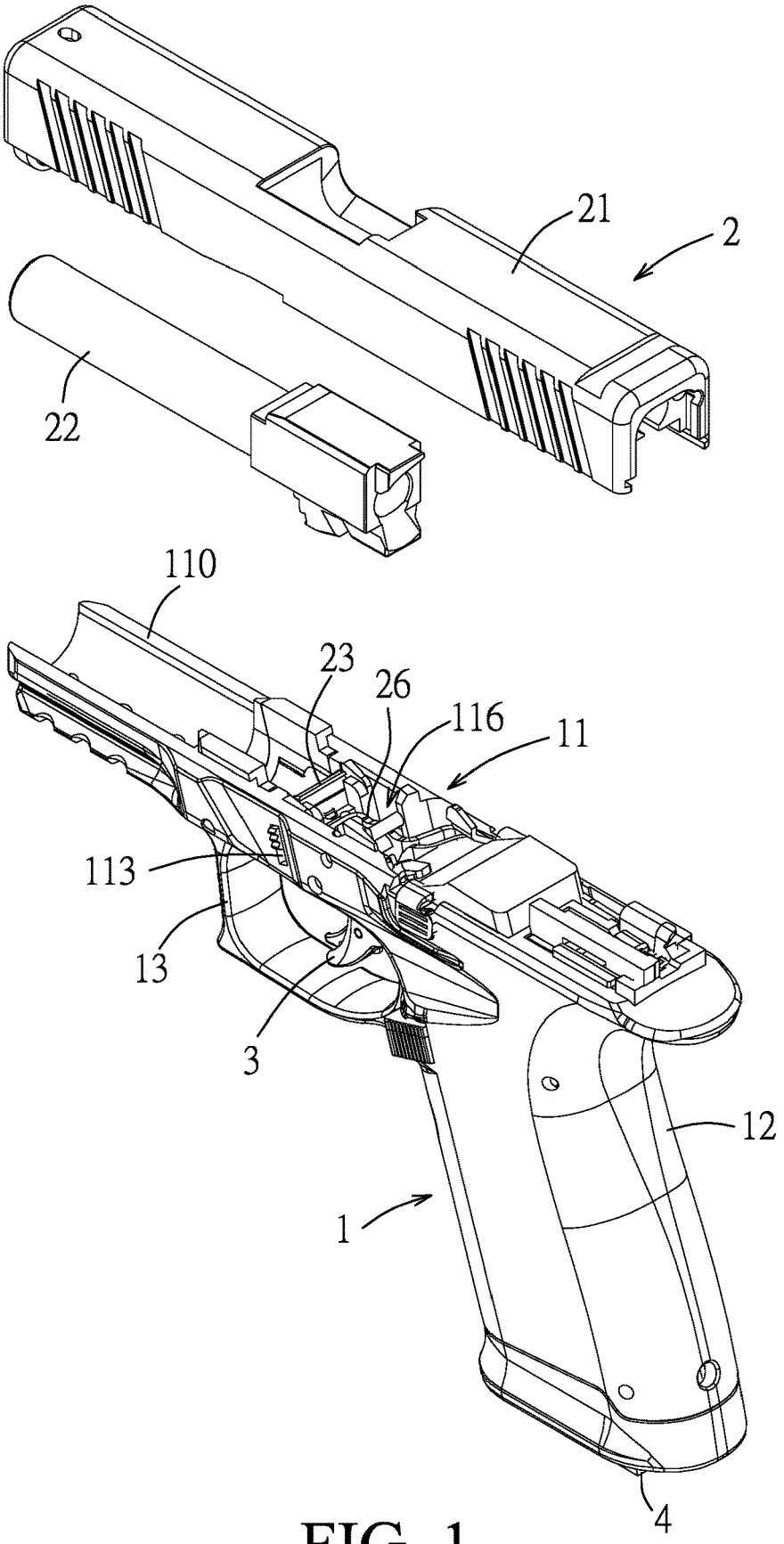
FIG. 1 is an exploded perspective view of a Glock pistol incorporating a frame according to an embodiment of the present disclosure.
Figure 2:
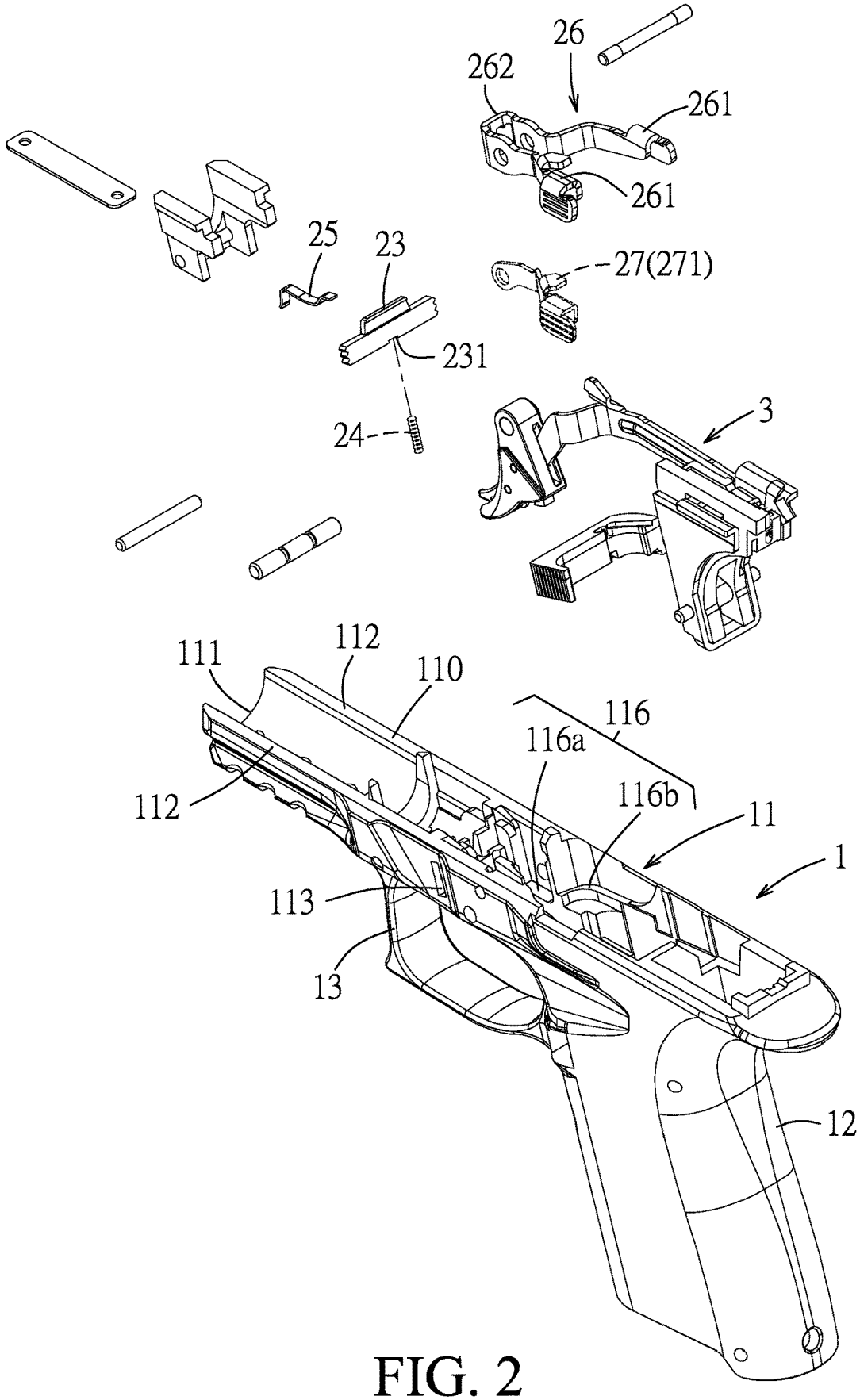
FIG. 2 is an exploded perspective view illustrating assembling relationship between the embodiment and some components of the Glock pistol.
Figure 3:
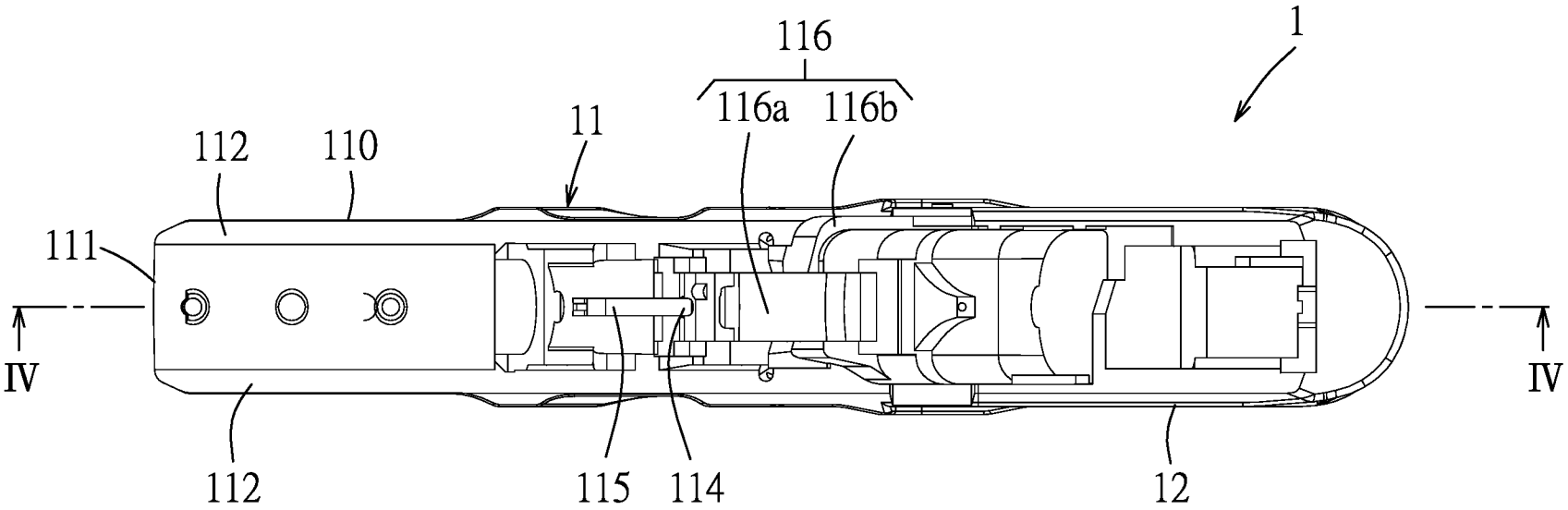
FIG. 3 is a schematic top view of the embodiment.
Figure 4:
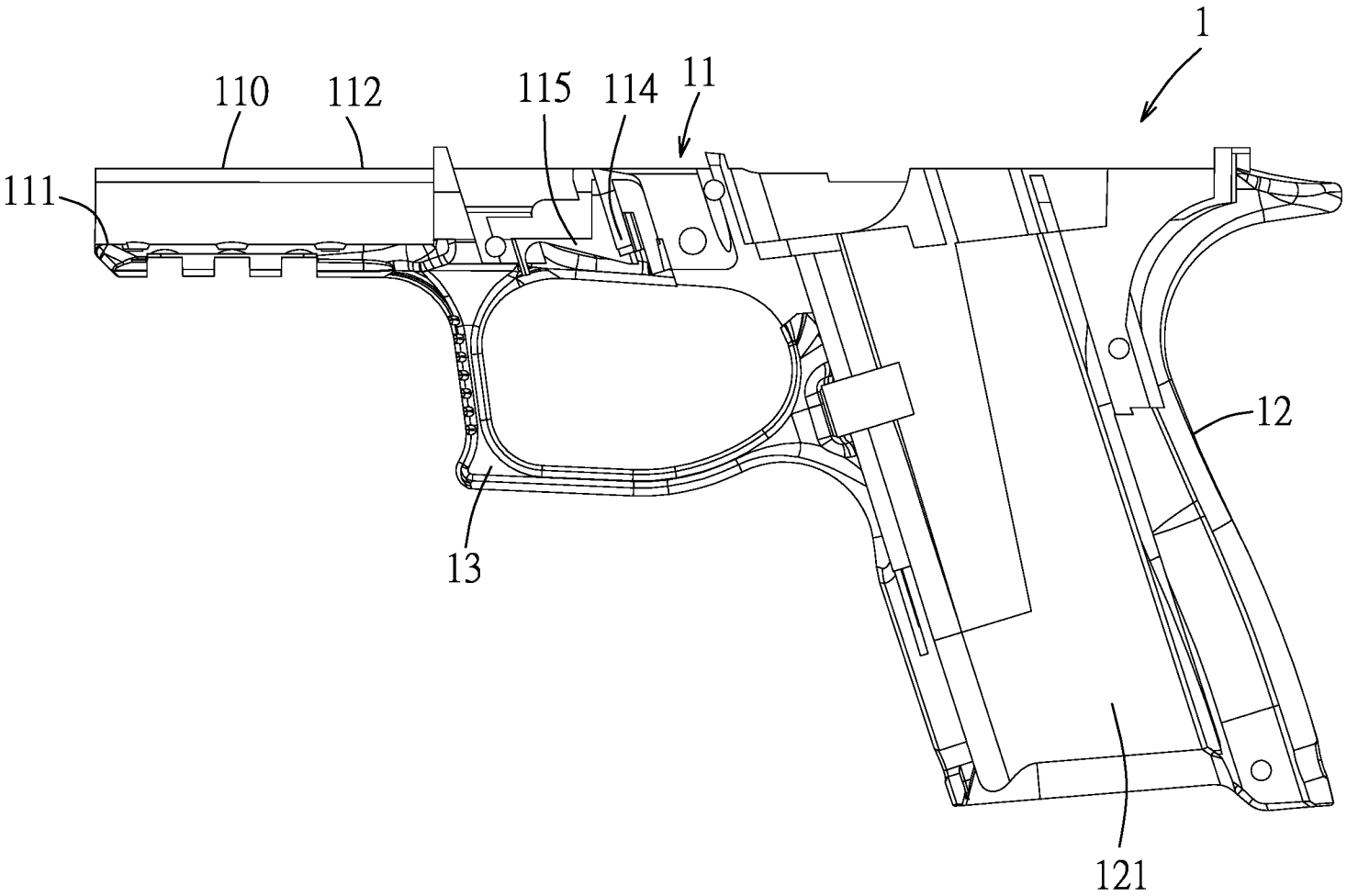
FIG. 4 is a sectional view of the embodiment taken along line IV-IV of FIG. 3.

Referring to FIGS. 1 to 4, a frame 1 according to an embodiment of the present disclosure is suitable to be assembled with a slide mechanism 2, a barrel 22, a trigger mechanism 3, and a magazine 4 for forming a Glock pistol.

The frame 1 of this embodiment includes an upper frame portion 11, a handgrip portion 12, and a trigger guard 13. The upper frame portion 11 extends along a front-rear direction, and includes a barrel-receiving section 110. The barrel-receiving section 110 includes a bottom wall 111, two sidewalls 112 extending upwardly and respectively from two opposite ends of the bottom wall 111, two through slots 113 respectively formed in the sidewalls 112, a compression spring retaining groove 114 formed in the bottom wall 111 between the through slots 113, and a spring plate retaining groove 115 extending forwardly from a top end of the compression spring retaining groove 114.

The handgrip portion 12 defines a magazine well 121 which is configured for accommodating the magazine 4, and has a top end connected to the upper frame portion 11 at a position proximate to a rear end thereof. The barrel-receiving section 110 is distal from the handgrip portion 12.

The trigger guard 13 is connected to and disposed between the handgrip portion 12 and the upper frame portion 11, and is located below the through slots 113.

The slide mechanism 2 includes a slide 21, a slide lock 23, a slide lock spring and a slide stop lever. The slide lock spring for use in this embodiment may be a compression spring 24 or a spring plate 25, and the slide stop lever for use in this embodiment may be a double-side slide stop lever 26 or a single side slide stop lever 27. The double-side slide stop lever 26 has two leg portions 261 and a bight portion 262 between the leg portions 261. The single side slide stop lever 27 has one leg portion 271.

Figure 5:
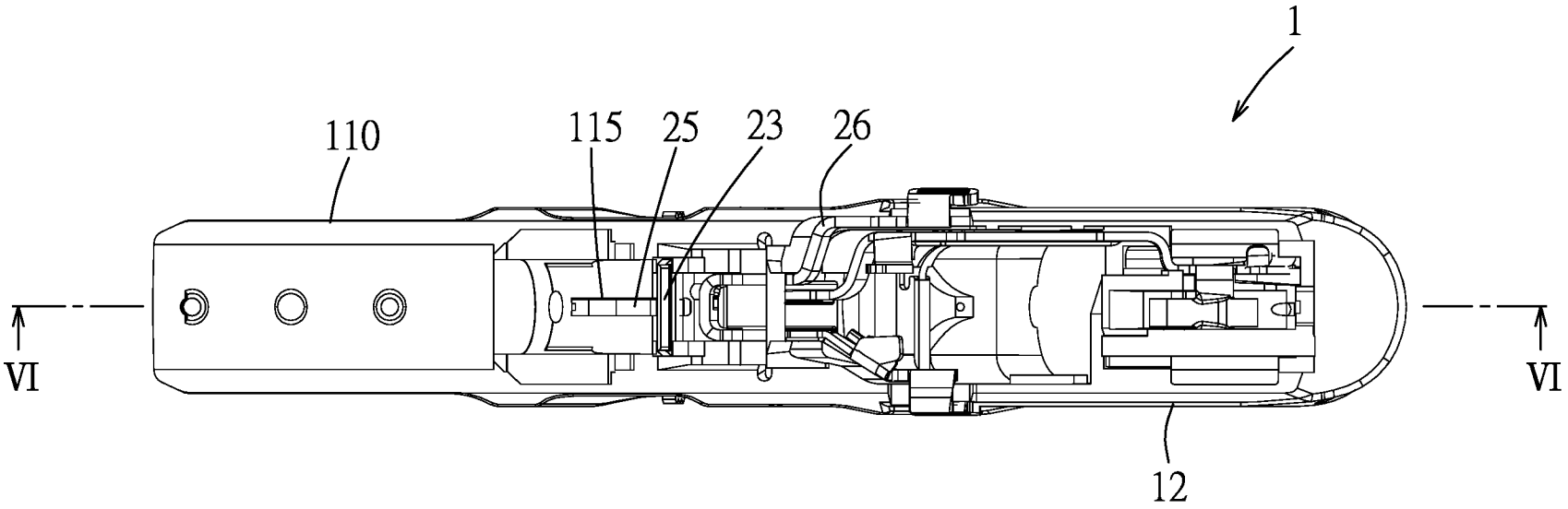
FIG. 5 is a view similar to FIG. 3, but with a portion of the components of the Glock pistol being assembled thereto.
Figure 6:
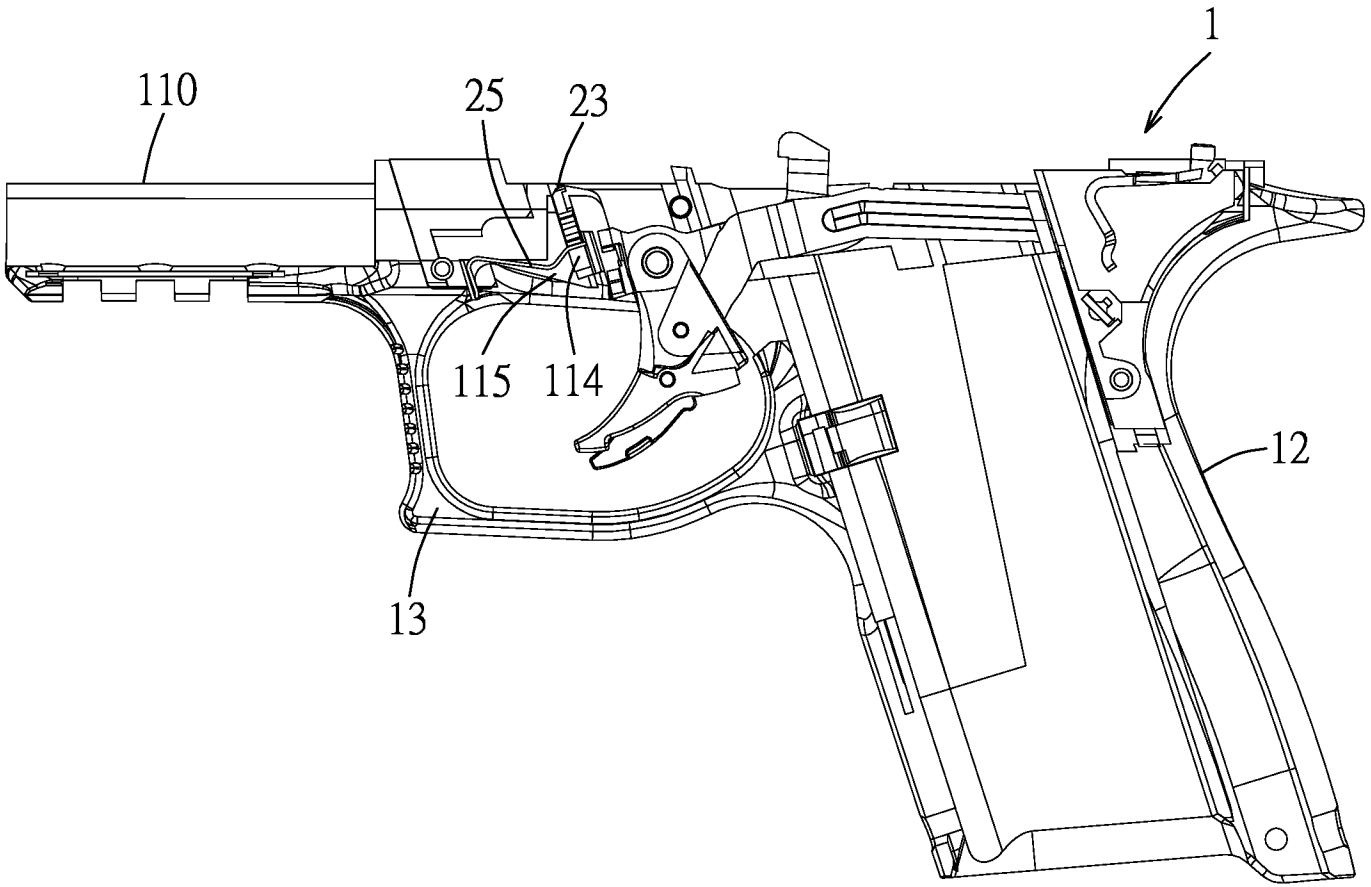
FIG. 6 is a sectional view taken along line VI-VI of FIG. 5.
Figure 7:
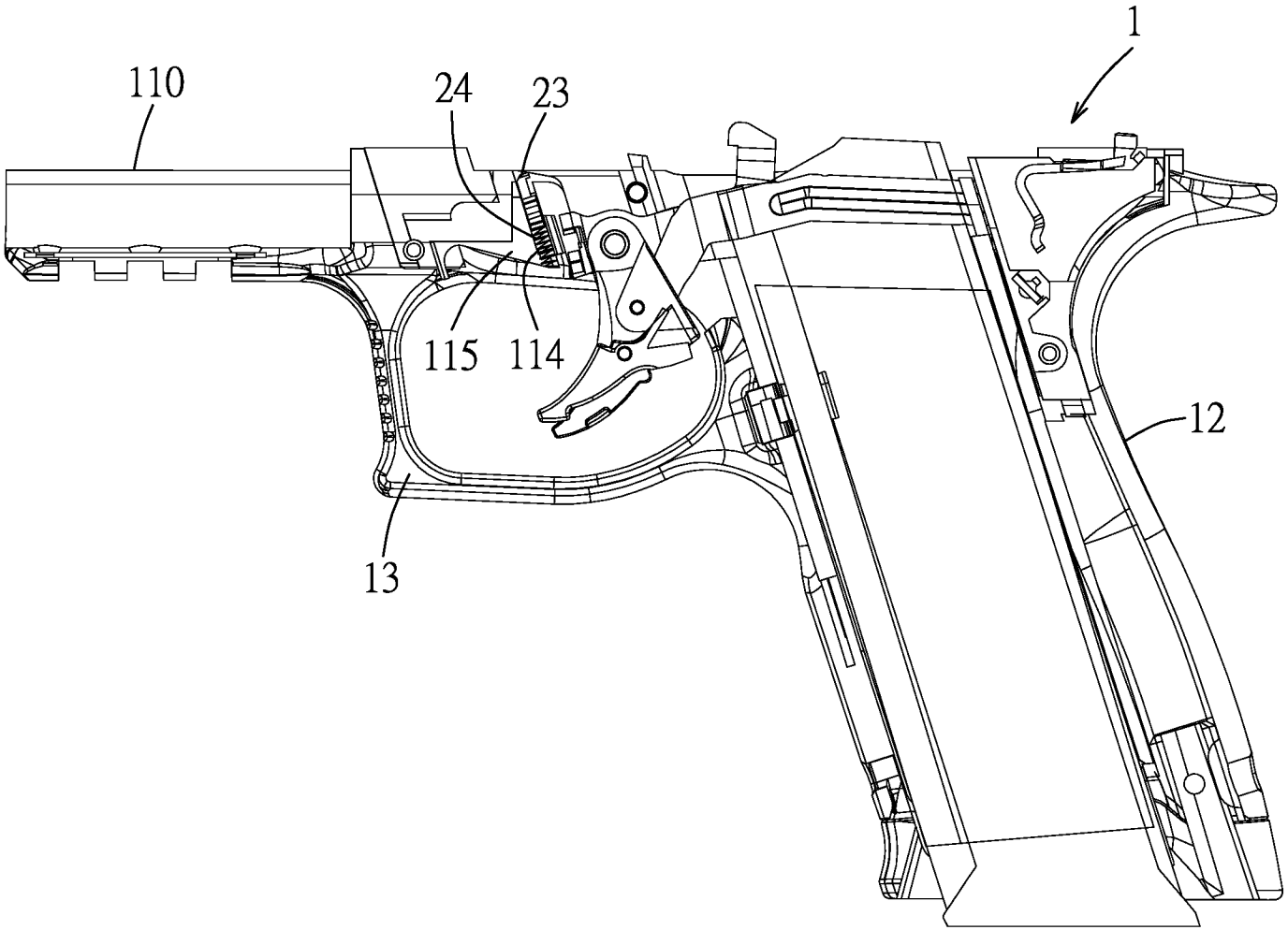
FIG. 7 is a view similar to FIG. 6, but with a spring plate being replaced with a compression spring.

The through slots 113 of the upper frame portion 11 extend in a top-bottom direction transverse to the front-rear direction for receiving two opposite ends of the slide lock 23 and for permitting upward and downward movement of the two ends of the slide lock 23 therein. The compression spring retaining groove 114 and the spring plate retaining groove 115 are located below the slide lock 23. A user may choose to install the compression spring 24 or the spring plate 25. As shown in FIGS. 5 and 6, the spring plate 25 is inserted into the spring plate retaining groove 115, and as shown in FIG. 7, the compression spring 24 is inserted into the compression spring retaining groove 114. When the spring plate 25 is inserted into the spring plate retaining groove 115, an end of the spring plate 25 is positioned in a notch 231 at the bottom portion of the slide lock 23 and pushes upwardly the slide lock 23 so as to provide a resilient restoring force when the slide lock 23 is compressed downwardly. Similarly, when the compression spring 24 is inserted into the compression spring retaining groove 114, a top end of the compression spring 24 is positioned in the notch 231 at the bottom portion of the slide lock 23 and pushes upwardly the slide lock 23 so as to provide the resilient restoring force when the slide lock 23 is compressed downwardly.

Referring back to FIGS. 1 to 3, the upper frame portion 11 further includes a slide stop lever-receiving section 116 located rearwardly of the barrel-receiving section 110. The slide stop lever-receiving section 116 includes a front receiving section (116*a*) proximate to the barrel-receiving section 110, and a rear receiving section (116*b*) extending rearwardly from the front receiving section (116*a*) opposite to the barrel-receiving section 110. The user may choose to dispose the double-side slide stop lever 26 or the single side slide stop lever 27 in the slide stop lever-receiving section 116. When the double-side slide stop lever 26 is disposed in the slide stop lever-receiving section 116, the bight portion 262 thereof is inserted into the front receiving section (116*a*) and the two leg portions 261 thereof are inserted into the rear receiving section (116*b*). When the single side slide stop lever 27 is disposed in the slide stop lever-receiving section 116, the leg portion 271 thereof is inserted into the rear receiving section (116*b*).

In summary, by having the compression spring retaining groove 114 and the spring plate retaining groove 115 for receiving the compression spring 24 and the spring plate 25, respectively, and the slide stop lever-receiving section 116 for receiving one of the double-side slide stop lever 26 and the single side slide stop lever 27, the flexibility of using the frame 1 of the present disclosure can be enhanced.

While the present disclosure has been described in connection with what is considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A frame of a pistol, comprising:

a handgrip portion defining a magazine well which is configured for accommodating a magazine;

an upper frame portion extending along a front-rear direction and connected to a top end of said handgrip portion, said upper frame portion including a barrel-receiving section distal from said handgrip portion, said barrel-receiving section including a bottom wall, two sidewalls extending upwardly and respectively from two opposite ends of said bottom wall, two through slots respectively formed in said sidewalls for receiving two opposite ends of a slide lock of a slide mechanism of the pistol, a compression spring retaining groove formed in said bottom wall between said through slots, and a spring plate retaining groove extending forwardly from a top end of said compression spring retaining groove, said through slots extending in a top-bottom direction transverse to the front-rear direction for permitting upward and downward movement of the two ends of the slide lock therein; and a trigger guard connected to and disposed between said handgrip portion and said upper frame portion, said trigger guard being located below said through slots.

2. The frame of a pistol as claimed in claim 1, wherein the slide mechanism of the pistol includes one of a double-side slide stop lever and a single side slide stop lever, said double-side slide stop lever having two leg portions and a bight portion between the leg portions, the single side slide stop lever having one leg portion, said upper frame portion further including a slide stop lever-receiving section located rearwardly of said barrel-receiving section, said slide stop lever-receiving section including a front receiving section proximate to said barrel-receiving section for receiving the bight portion, and a rear receiving section extending rearwardly from said front receiving section opposite to said barrel-receiving section for receiving at least one of the leg portions.

* * * * *